US007124528B2

(12) United States Patent
Long

(10) Patent No.: US 7,124,528 B2
(45) Date of Patent: Oct. 24, 2006

(54) FIREARM PISTOL GRIP MONOPOD GUN STABILIZER

(75) Inventor: Matthew Wayne Long, Weatherford, TX (US)

(73) Assignee: Matthew W Long, Weatherford, TX (US)

( * ) Notice: Subject to any disclaimer, the term of this patent is extended or adjusted under 35 U.S.C. 154(b) by 187 days.

(21) Appl. No.: 10/906,419

(22) Filed: Feb. 18, 2005

(65) Prior Publication Data

US 2006/0185214 A1 Aug. 24, 2006

(51) Int. Cl.
*F41C 23/00* (2006.01)

(52) U.S. Cl. ..... 42/71.02; 42/94; 211/64

(58) Field of Classification Search ..... 42/71.02, 42/71.01, 94, 72

See application file for complete search history.

(56) References Cited

U.S. PATENT DOCUMENTS 2,844,905 A * 7/1958 Musser et al. ..... 72/94
3,683,535 A * 8/1972 Lewis ..... 42/71.02
5,274,940 A * 1/1994 Guzy ..... 42/94
6,305,116 B1 * 10/2001 Parker ..... 42/94
6,487,807 B1 * 12/2002 Kopman et al. ..... 42/94
6,536,152 B1 * 3/2003 Wisz ..... 42/71.01
2002/0040544 A1 * 4/2002 Muhlestein ..... 42/94
2005/0011101 A1 * 1/2005 Gooder ..... 42/71.01

* cited by examiner

*Primary Examiner*—Michelle Clement

(57) ABSTRACT

The invented firearm pistol grip monopod gun stabilizer reduces rifle movement to improve the shooter's aim by using an adjustable elongated member connected inside the firearms pistol grip. A threaded rod assembly provides a means for precise height adjustment while a footpad resting on a supporting surface provides stability during recoil, and while the front of the firearm rest on a bi-pod or other support. A head cap screw on one end of the monopod gun stabilizer connects it to the firearm and a footpad on the other end of the monopod gun stabilizer rests on the ground. In between the two ends a female tubular assembly and a threaded rod assembly provide for precise adjustment for targeting. The monopod gun stabilizer threads into it self for transport and storage. The monopod gun stabilizer is particularly effective with the additional use of a front pod unit, that is a monopod, bi-pod or tripod at a point, forward of the receiver, so that the monopod gun stabilizer moves the firearm up or down pivoting on the front pod unit.

2 Claims, 1 Drawing Sheet

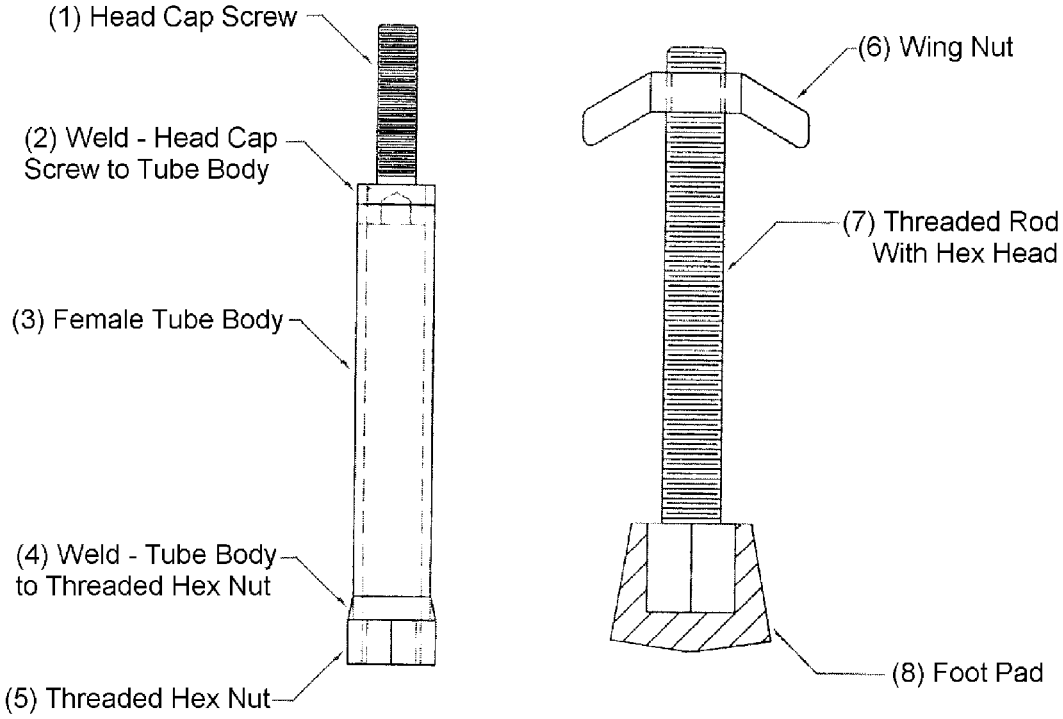
Figure 1
FIGURE 2
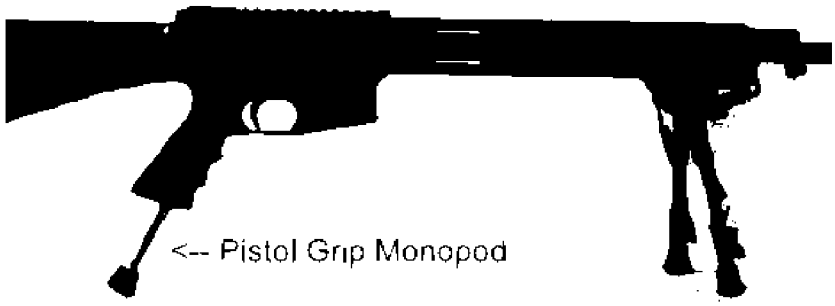

FIREARM PISTOL GRIP MONOPOD GUN STABILIZER

BACKGROUND OF THE INVENTION

Field of the Invention

This invention relates to guns and gun supports. Specifically, the device relates to firearm stabilization for improve accuracy and for reducing the firearm user's fatigue.

SUMMARY OF THE INVENTION

The present invention is a FIREARM PISTOL GRIP MONOPOD GUN STABILIZER, hereafter referred to as "monopod gun stabilizer," that stabilizes the firearm to improve shot accuracy and reduce the firearm's movement before and during recoil. The monopod gun stabilizer provides a mid-rear support leg that when used with a front support provides a compact and stable system to reduce fatigue while aiming or waiting for the desired shot.

The monopod gun stabilizer comprises of a single elongated member that is used with some type of front support, but not connected to it. The monopod gun stabilizer has an adjustment system that allows for lengthening or shorting of the elongated member in extremely fine-adjustments.

The monopod gun stabilizer is a simple and effective device that meets the need for a compact and light gun stabilizer for the pistol grip of a firearm. The monopod gun stabilizer includes on one end a threaded connector that attaches to the firearm by replacing the pistol grip screw of the firearm. The monopod gun stabilizer includes on the other end a footpad for resting on ground or other surface. Between the connector and the footpad there is a female tubular receptacle and a threaded rod for adjustment. The threaded rod provides for precise height-adjustment and stabilization of the firearm. The monopod gun stabilizer when used with a bi-pod provides a stable three-leg support system that reduces fatigue while aiming or waiting for the desired shot and increases stabilization during recoil.

The preferred device is constructed from two major components: a female tubular assembly, and a threaded rod assembly with a footpad. Preferably the female tubular assembly connects to the firearm by replacing the pistol grip screw of the firearm. The threaded rod assembly connects to the female tubular assembly by threading into the lower end of it.

Another embodiment of the monopod gun stabilizer is constructed in a similar but opposite manner, which includes two major components: a threaded rod assembly, and a female tubular assembly with a footpad. The threaded rod assembly connects to the firearm by replacing the pistol grip screw of the firearm. The female tubular assembly with a footpad connects to the threaded rod assembly by threading onto it.

The invent device may vary and be molded or manufactured into the firearms pistol grip.

BRIEF DESCRIPTION OF THE DRAWING

FIG. 1 is a schematic side view of the monopod gun stabilizer, which is symmetric around itself.

FIG. 2 is a side view of the monopod gun stabilizer connected to a rifle in its extended state with a bi-pod near the front of the gun.

DETAILED DESCRIPTION OF THE INVENTION

Referring to the Figures the monopod gun stabilizer is comprised of a female tube body (3), a threaded rod (7), and a standard wing nut (6).

The female tube body (3) has a head cap screw (1), which is welded (2) the female tube body (3) as depicted in FIG. 1. The head cap screw (1) is identical to the grip screw on whatever firearm the monopod gun stabilizer is going to be connected to. The female tube body (3) has a threaded hex nut (5) welded (4) to it at the opposite side of head cap screw (1) as to permit a rod to be threaded into the female tube body (3). The threaded hex nut (5) may accept a standard socket to allow the female tube body (3) to be installed in place of the grip screw on the firearm. The threaded rod (7) has a hex head on one end so that the footpad (8) may be attached to it. The standard wing nut (6) is threaded onto the threaded rod (7) upside-down and then the threaded rod (7) is threaded into female tube body (3). The threaded rod (7) maybe either fully threaded into the female tube body (3) for storage while not in use or adjusted out to the desired height. The standard wing nut (6) is used to thread up tightly to the threaded hex nut (5) on the female tube body (3) to allow a firm attachment of the threaded rod (7) while either not in use or extended to the desired height.

The invention has two general positions that may generally be called extended and stored. The preferred position for use is extended. While used in conjunction with a bi-pod the firearm is stabilized to improve shot accuracy and reduce fatigue to the shooter. In the stored position the monopod gun stabilizer is out of the way permitting storage of the firearm without removal of the monopod gun stabilizer.

The preferred monopod gun stabilizer has an all-metal construction with a rubbery footpad or other wise gripping surface. Although this invention has been described above with reference to particular means and materials, it is not limited to these disclosed particulars and extends to all equivalents with in the scope of the following claims.

What is claimed is:

1. An adjustable monopod firearm stabilizer comprising an elongated member in combination with a firearm pistol grip, the pistol grip including a pistol grip screw and aperture for attaching the pistol grip to a firearm, the elongated member including:

a female tubular body including a threaded connector on one end for attaching to the firearm pistol grip by replacing the pistol grip screw of a firearm, the female tubular body being open at an opposite end and having an internally threaded cavity and a threaded hex nut attached to the open end of the female tubular body, a threaded rod having a hex head on one end and a footpad attached to the hex head, wherein the female tubular body is located within the pistol grip so that the threaded connector attaches the pistol grip to a firearm through a pistol grip screw aperture, wherein the threaded rod is threaded into the internal cavity of the female tubular body through the open end, so that the threaded rod may be either fully threaded into the female tubular body for storage while not in use or adjusted out to a desired height.

2. The adjustable monopod firearm stabilizer of claim 1, wherein the threaded rod further comprises a wing nut, wherein the wing nut is threaded tightly against the hex nut on the female tubular body to allow a firm attachment of the threaded rod.

* * * * *